United States Patent [19]

Sheldon et al.

[11] 4,202,225

[45] May 13, 1980

[54] POWER TONGS CONTROL ARRANGEMENT

[76] Inventors: Loren B. Sheldon, 8226 Bairnsdale, Houston, Tex. 77070; James R. Tomashek, 114 E. Division St., Wood Dale, Ill. 60191; Donald H. Ward, 418 Ridgewood, Glen Ellyn, Ill. 60137

[21] Appl. No.: 26,820

[22] Filed: Apr. 4, 1979

Related U.S. Application Data

[63] Continuation of Ser. No. 777,926, Mar. 15, 1977, abandoned.

[51] Int. Cl.[2] ..... B25B 13/50

[52] U.S. Cl. ..... 81/57.35; 173/164; 175/85; 364/104; 81/57.34

[58] Field of Search ..... 364/104, 107, 118, 121, 364/420, 422; 81/57.35, 57.33, 57.34; 173/164; 175/52, 85

[56] References Cited

U.S. PATENT DOCUMENTS

| | | | |
|---|---|---|---|
| 2,988,237 | 6/1961 | Devol, Jr. | 214/11 R |
| 3,279,624 | 10/1966 | Devol | 214/1 BC |
| 3,283,918 | 11/1966 | Devol | 83/292 |
| 3,306,471 | 2/1967 | Devol | 214/1 BC |
| 3,881,375 | 5/1975 | Kelly | 81/57.35 |

OTHER PUBLICATIONS

Ward et al., "A Computer-Controlled System for Automated Racking of Pipe on Drilling Vessels", Journal of Pet. Tech., Mar. 1976, pp. 253-258.

*Primary Examiner*—Errol A. Krass
*Attorney, Agent, or Firm*—George M. Medwick

[57] ABSTRACT

Apparatus for controlling a tongs arrangement which includes a tongs lift and lift speed arrangement, a backup tong and a power driven tong, is characterized by means for generating electrical signals to lift the backup tong and power tong at a predetermined speed to a predetermined elevation, means for generating an electrical signal to close and lock the backup tong when lifted, and means for generating an electrical signal to drive the power driven tong when the backup tong is closed and locked.

22 Claims, 12 Drawing Figures

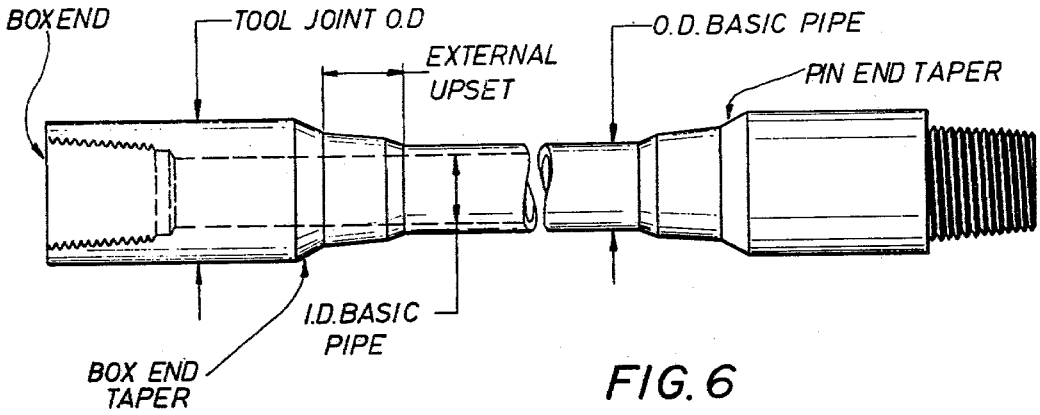
FIG. 6
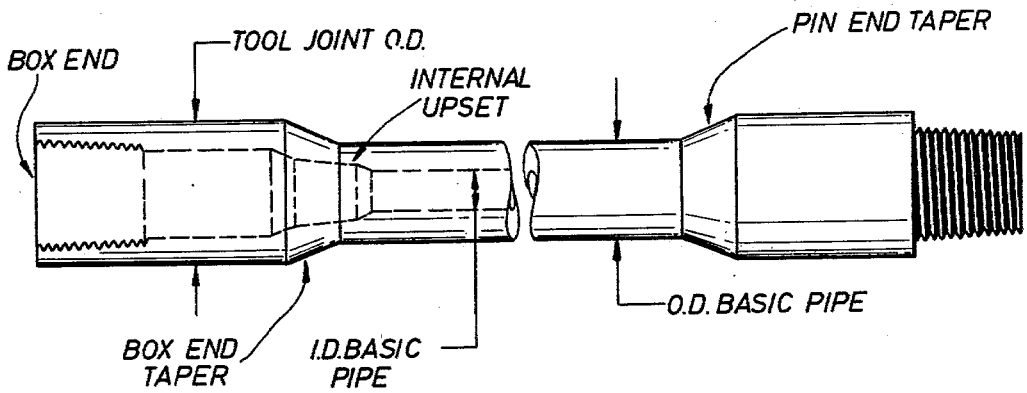
FIG. 2
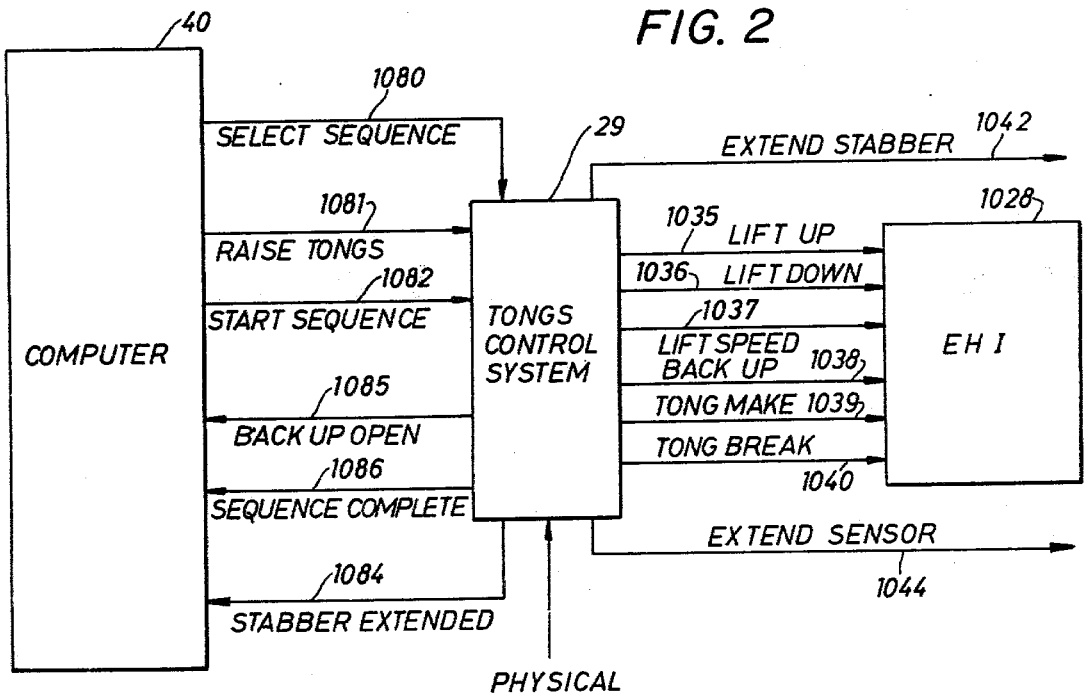

TONG MAKE
1039
1040
TONG BREAK
1085
BACK UP OPEN
LIFT DOWN
1036
1141
1145
1166
1154
1155B
1140
1144
1154A
1165
t3
1155A
MAKE UP FF
1135
1139
1143
1199
1158
12
1198
1160
1137A
1137B
1195
1157
1196
1197
P
R
1161
U
V
1138
1151B
1162
1173
11
1152
t1
1191
1147
1151A
1150
1172
t5
1148
13
14
15
16
17
18
19

POWER TONGS CONTROL ARRANGEMENT

This is a continuation of application Ser. No. 777,926, filed Mar. 15, 1977, now abandoned.

CROSS REFERENCE TO RELATED APPLICATIONS

Subject matter disclosed and claimed herein is disclosed in the following copending applications, each assigned to the assignee of the present invention:

Computer-Controlled Oil Drilling Rig Having Drawworks Motor and Brake Control Arrangement, Ser. No. 777,724, filed Mar. 15, 1977 in the names of James P. Heffernan, Loren B. Sheldon, James R. Tomashek and Donald H. Ward;

Electro-Hydraulic Interface For A Power Tongs, Ser. No. 777,672, filed Mar. 15, 1977, now U.S. Pat. No. 4,139,891 in the names of Loren B. Sheldon; and Robert R. Kelly;

Joint Sensor For A Power Tongs, Ser. No. 003,035, filed Jan. 12, 1979 in the name of Loren B. Sheldon, a continuation of application Ser. No. 777,673, filed Mar. 15, 1977, now abandoned.

BACKGROUND OF THE INVENTION

1. Field of the Invention

This invention relates to a control arrangement for a power tongs.

2. Description of the Prior Art

Manually operable power tongs to effect the making and breaking of the joint between elements of a drill string are known in the art. The tongs manual control console usually is provided with four levers, each of which controls a pilot valve of a small four-section stack valve. Each pilot valve controls one main function of the commonly utilized tongs structure.

For example, one valve controls the opening and closing of the backup tong. A second valve controls the tongs motor to rotate the power driven tong. The lift speed of the tongs is controlled by a third valve, while a fourth valve controls the upward or downward movement of the tongs lift. Of course, other tong's functions as, for example, the extension of the stabber (if one is provided) or the extension of a joint sensor would require a manual valve for the operation of each.

It would be advantageous to automatically control a power tongs arrangement by utilization of an electrical tongs control system. However, if an electrical control system is utilized, it is necessary to provide a suitable electro-hydraulic interface to permit valves which are manually operable to be operable in response to electrical signals output from the control system. To locate the power driven tong and backup tong in a predetermined operating relationship with respect to the tool joint, a joint sensor arrangement is advantageously utilized.

SUMMARY OF THE INVENTION

This invention relates to an apparatus for controlling a tongs arrangement which includes a tongs lift, a tongs lift speed arrangement, a backup tong, and a power driven tong. The control apparatus includes means for generating an electrical signal to raise the tongs at a predetermined speed to a predetermined elevation. Means for generating an electrical signal to close and lock the backup tong when it is lifted to the predetermined elevation is included. Means is provided for generating an electrical signal to drive a power driven tong when the backup tong is closed and locked. The control arrangement disclosed herein may advantageously be utilized in connection with a computer-controlled oil drilling derrick as disclosed and claimed in the first-referenced copending application. Program flow charts and listing are appended hereto.

BRIEF DESCRIPTION OF THE DRAWINGS

The invention will be more fully understood from the following detailed description of a preferred embodiment thereof, taken in connection with the accompanying drawings which form a part of this specification and in which:

FIG. 2 is block diagram indicating the interconnection between a programmable general purpose digital computer and the tongs control assembly according to this invention;

DESCRIPTION OF THE PREFERRED EMBODIMENT

Figure 1:
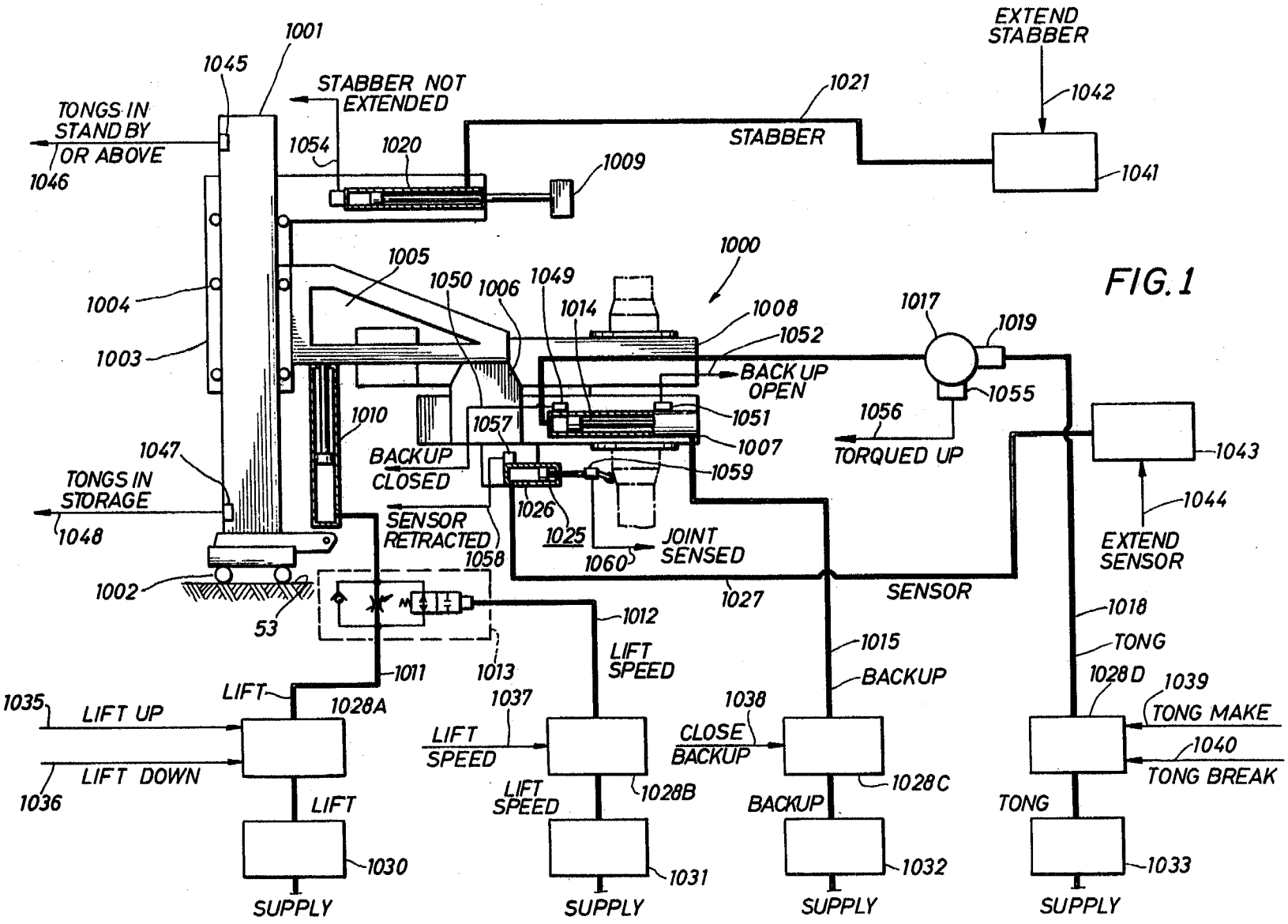
FIG. 1 is a highly stylized pictorial representation of a power tongs assembly illustrating conventional tong elements and elements associated therewith according to this invention.

Through the following description, similar reference numerals refer to similar elements in all Figures of the drawings.

POWER TONGS STRUCTURE

Power tongs for making and breaking joints between a pipe stand and a drill string are well-known in the art. For example, U.S. Pat. No. 3,881,375, issued to Robert R. Kelly and assigned to the Assignee of the present invention, discloses the basic structure of a power tongs assembly. In FIG. 1, shown is a highly stylized pictorial representation of a power tongs assembly 1000. FIG. 1 illustrates the main structural elements common to all power tongs assemblies and also diagrammatically illustrates additional structural elements provided in accordance with this invention.

The tongs assembly 1000 is located adjacent to the slips provided on the floor of the derrick 20. As is typical and well-known to the art, the tongs 1000 are mounted on a vertical column 1001, itself mounted on bearings 1002 to permit the tongs 1000 to swing into and out of alignment with the bore being generated. A collar 1003 is mounted, as by rollers 1004, for movement along the vertical column 1001. A tongs supporting yoke 1005 is mounted to the collar 1003 and projects horizontally therefrom. The yoke 1005 supports a cradle 1006 in which a backup tong 1007 and a power driven tong 1008 are disposed. The backup tong 1007 is adapted to hold one (usually the lower) section of the pipe sections defining the joint to be made-up or broken-out against rotation while the driven tong engages the other section to rotate the same in a predetermined direction. The direction of rotation depends upon whether the joint is being made-up or broken-out.

Also mounted on the column 1001 in any suitable relationship thereto (shown in FIG. 1 as being in cooperative association with the collar 1003) is a stabber 1009. As is well-known to those skilled in the art, the stabber 1009 may or may not be provided in a conventional tongs assembly, but if it is so provided, the stabber 1009 is operative to assist in locating or "stabbing" the next pipe stand to be added to the drill string during a make-up cycle. Since the structures discussed are conventional, it is understood that any suitable configuration of elements exhibiting these functions and operating to effect the make-up or break-out of a joint in the drill string may be controlled by a control system 29 embodying the teachings of this invention.

As is also conventional in the art, a tongs lifting arrangement 1010 is provided. The arrangement 1010 comprises means for lifting the tongs from a lower, or storage, position to an upper, or standby, position and, past the standby position to a still-further upward operating position. Any suitable means may be utilized , as illustrated by the piston-cylinder arrangement associated with a chain drive. Fluid, such as pressurized hydraulic oil, for controlling the lifting and lowering motion of the tongs is conducted from a fluid supply to the piston-cylinder arrangement 1010 on a fluid line 1011. The speed at which the tongs are raised from the storage to the standby positions and from the standby to the operating positions is regulated by the fluid in a line 1012 having a restrictor 1013 therein.

Included within the backup tong 1007 is means 1014, such as a piston-cylinder arrangement, for opening and closing the backup tong 1007. Fluid, such as pressurized hydraulic oil for operating the piston-cylinder arrangement 1014 is conducted thereto on a line 1015. Similarly, means 1017, such as a tongs motor, are provided in operative association with the driven tong 1008 for opening and closing the jaws of the power driven tong and for rotating the power driven tong 1008 in a predetermined direction to effect the make-up or break-out of the joint. Fluid for operating the tongs motor 1017 is carried on a line 1018 to a cylinder 1019 related thereto. Means 1020, such as a piston-cylinder arrangement, is associated with the stabber 1009 for controlling the extension thereof. Fluid, such as pressurized air, utilized to energize the piston-cylinder 1020 is conducted thereto on a line 1021. Each of these above means for lifting the tongs at a predetermined lift speed, for opening and closing the backup tong, for closing the tongs motor jaws and rotating the same, and for extending the stabber, are conventional in the art and any arrangement to accomplish the recited functions may be made compatible with the control system 29 embodying the teachings of this invention.

The tongs 1000 also include a joint sensor arrangement 1025 embodying the teachings of this invention. The joint sensor 1025 is described in complete detail in connection with FIGS. 5A and 5B. It generally comprises a sensor arrangement having a pivotally mounted roller arm with a limit switch associated therewith such that deflection of the arm by a predetermined portion of a drill pipe (as, for example, the box end taper) actuates the limit switch. When the limit switch is actuated, it is then known that a predetermined location on the drill pipe has been reached by the roller. Further, due to the standardization of drill pipes for oil drilling work, it is also known that any other feature of the pipe, such as the joint itself, is then a predetermined known distance from the location on the pipe which energized the limit switch.

The joint sensor 1025 includes means 1026, such as a piston-cylinder arrangement, for extending the sensor to contact the pipe. Fluid (such as pressurized air) to actuate the extension means 1026 is carried by a line 1027.

In a conventional arrangement, a manually operated valve 1030 is disposed in association with the fluid line 1011 (LIFT) to regulate the flow of fluid therein. The valve 1030 is usually operable in two directions to energize the lift means 1010 for upward or downward movement of the tongs along the vertical column 1001. A manual valve 1031 is associated with the fluid line 1012 (LIFT SPEED) and is manually operable to adjust the speed at which the tongs are raised. Usually, the speed is variable from a first, normal, speed exhibited during movement of the tongs from the storage to the standby positions, to a second, slower, speed exhibited during movement of the tongs from the standby to the operating positions during which time the sensor is extended to sense the joint.

A manually operated valve 1032 is associated with the hydraulic line 1015 (BACKUP) to regulate the flow of hydraulic fluid therein to the backup 1007. Manual actuation of the valve 1032 controls the opening or closing of the backup tong 1007, as is appreciated by those skilled in the art. A valve 1033 is associated with the fluid line 1018 (TONG) connected to the tongs motor 1017 to control the opening and closing of the power driven tong 1008 and the rotation thereof. The valve 1033 is similar to the valve 1030 and is a two-direction manual valve which in one position operates the tongs motor 1017 to make up a drill string while in the other position operates the tongs motor 1017 to break out a joint in the drill string.

If a stabber 1020 is utilized, a manual valve may be provided therefor operative to control passage of fluid in the line 1021 (STABBER) to extend or retract the stabber. Further, it would be appreciated by those skilled in the art if a joint sensor 1025 embodying the teachings of this invention is utilized in a manual tongs assembly, the extension of the joint sensor may be manually effected through the provision of an appropriate manual valve regulating the flow of fluid (such as pressurized air) on the line 1027 (SENSOR) to control the extension and retraction thereof.

Since, in the conventional arrangement above-described (with the exception of the joint sensor 1025), the control of the tongs structure is effected by the manual manipulation of valves in the fluid lines, it would be advantageous to provide an automated electronic control system, such as the tongs control system 29 (FIG. 3), to electronically operate the tongs structure. Such a control system is provided by this invention. However, since the outputs of the control system 29 are electrical control signals, and since the above-discussed conventional tongs assembly utilizes fluid energized operators, it is necessary to provide an electro-hydraulic interface (E.H.I.) module intermediate the tongs control system 29 and the tongs structure 28 controlled thereby. This module is illustrated diagrammatically in FIG. 1 and discussed in complete detail in connection with FIG. 1A. Each interface module is generally indicated by reference numeral 1028 and is provided to disenable the manually operated valve with which it is associated and to substitute therefor an electrically responsive valve adaptable to be controlled by the electrical output signals from the tongs control system 29.

In general, the interface module 1028 includes an electrically operated solenoid valve connected in parallel relationship with the manually operated valve and in the same cooperative relationship with the fluid line through which the structure of the tongs communicates with the source of fluid therefor. Further, each interface module includes means for selectively enabling the electrically operated valve and simultaneously disenabling the manual valve. The select means can conveniently be an electrically or manually operable switch arrangement, or any other suitable arrangement. Thus, dependent upon the operative mode (automatic or manual) selected, either the electrically operated valve or the manually operated valve will be determinative as to the passage of hydraulic fluid in the lines with which it is associated.

As seen in FIG. 1, four interface modules 1028A, 1028B, 1028C and 1028D are provided so as to make the abovedescribed conventional system responsive to the electrical signal outputs from the tongs control system 29. (Of course, if a conventional system utilized other manually operated valves, an interface module could be provided to make the function provided by that manually-operated valve electrically controllable.) The interface module 1028A (LIFT) is associated with the fluid line 1011 and controls movement of the tongs 1000 in a vertically upward and vertically downward direction. Since the manually operated valve 1030 with which the interface 1028A is associated is a four-way valve, the electrically responsive valve connected in parallel relationship to the valve 1030 within the interface 1028A is similarly a four-way valve. Therefore, electrical lines 1035 (LIFT UP) and 1036 (LIFT DOWN) are input to the interface module 1028A from the tongs control system 29. The presence of a signal on the appropriate line 1035 (LIFT UP) or 1036 (LIFT DOWN) from the tongs control system 29 initiates, respectively, an upward lifting movement of the tongs 1000 and a downward movement thereof.

The interface module 1028B is associated with the manually operated valve 1031 and includes a valve connected in parallel relationship thereto which is responsive to an electrical signal on an electrical line 1037 (LIFT SPEED) to control the rate of upward speed at which the tongs 1000 are moved. The interface module 1028C includes a valve connected in parallel relationship with the manually operated valve 1032, the interface valve being responsive to a signal on an electrical line 1038 (BACKUP) from the tongs control system 29. Energization of the line 1038 with the manual valve 1032 disenabled actuates the electrically responsive valve within the interface module 1028C to effect the closing of the backup tong 1007. Interface module 1028D includes an electrically responsive valve connected in parallel relationship with the manually operated valve 1033 and is actuable to control the tongs motor 1017 to makeup or break-out a joint. Since the manually operated valve 1033 is operable in two-directions, the electrically responsive valve within the interface module 1028D is responsive to signals from the tongs control system 29 on electrical lines 1039 (TONG MAKE) or 1040 (TONG BREAK) to respectively initiate motion of the tongs motor 1017 to drive the driven tong 1008 to make-up or break-out the joint. It is understood that if other manual control valves were provided in a particular manually operated tongs assembly, suitable interfaces embodying the teachings of this invention may be provided to automate the functions performed thereby and make control thereof possible by the use of the tongs control system 29 embodying the teachings of this invention.

A four-way single solenoid, spring offset electrically responsive valve 1041 responds to an electrical signal on a line 1042 (EXTEND STABBER) from the tongs conrol system 29 to control the passage of fluid in the line 1021 to actuate the piston-cylinder arrangement 1020 to extend or retract the stabber 1009. A four-way, single solenoid, spring offset electrically responsive valve 1043 (similar to the valve 1041) responds to an electrical signal from the tongs control system 29 on a line 1044 (EXTEND SENSOR) to actuate the piston-cylinder arrangement or other suitable extension means 1026 disposed within the joint sensor 1025. It is, of course, understood that if either of these last two functions were provided by a manually operated control valve in a particular manually operated tongs assembly, a suitable interface module would be provided to disenable the manually operated valve and selectively enable the electrically responsive valve to permit automated control of the tongs assembly by a control system embodying the teachings of this invention.

In order to provide automated control of the tongs structure 28, suitable feedback signal generating means, commonly limit switches, are disposed at predetermined locations within the structure of the tongs. An upper limit switch 1045 is disposed so as to output a signal on a line 1046 (TONGS IN STANDBY OR ABOVE) to the tongs control system 29 representative of the fact that the tongs have been raised on the column 1001 to at least the standby position. A lower limit switch 1047 is mounted within the tongs structure 28 and outputs a feedback signal on the line 1048 (TONGS IN STORAGE) to the tongs control system 29 representative of the fact that the tongs are in a storage position along the vertical column 1001.

Suitable means, as a pressure sensing switch 1049 disposed on the backup tong 1007 outputs a feedback signal on a line 1050 (BACKUP CLOSED) to the tongs control system 29 representative of the fact that the backup tong is in the closed and locked condition. Similarly, a limit switch or other suitable detector 1051 outputs an electrical signal on a line 1052 (BACKUP OPEN) to the tongs control system 29 representative of the fact that the backup tong 1007 is open. Suitable means, such as a limit switch 1053, outputs a signal on a line 1054 (STABBER NOT EXTENDED) to the tongs control system 29 representative of the fact that the stabber 1009 is in the extended or not extended position. Feedback signal generating means, such as a switch or pressure transducer 1055, disposed on the tongs makeup cylinder 1019 associated with the tongs motor 1017, outputs a signal to the tongs control system 29 on a line 1056 (TORQUED UP) indicative of a fully torqued condition of the tongs motor 1017 and representative of the fact that during a make-up cycle the joint has been adequately made-up.

The joint sensor 1025 embodying the teachings of this invention includes feedback signal generating means such as limit switch 1057 outputting a signal on a line 1058 (JOINT SENSOR RETRACTED) to the tongs control system 29 representative of the fact that the joint sensor is in the retracted position. When a joint is sensed, a feedback signal from the limit switch 1059 associated with the detector in the joint sensor 1025 outputs a signal on a line 1060 (JOINT SENSED) to the tongs control system 29 representative of the fact that the joint has been sensed.

A full discussion of the manner in which the abovelisted feedback signal are utilized by the tongs control system 29 to energize appropriate ones of the output lines to the electrically responsive valves located within the interface modules 1028 is discussed fully in connection with the tongs control system 29, herein.

Figure 1A:
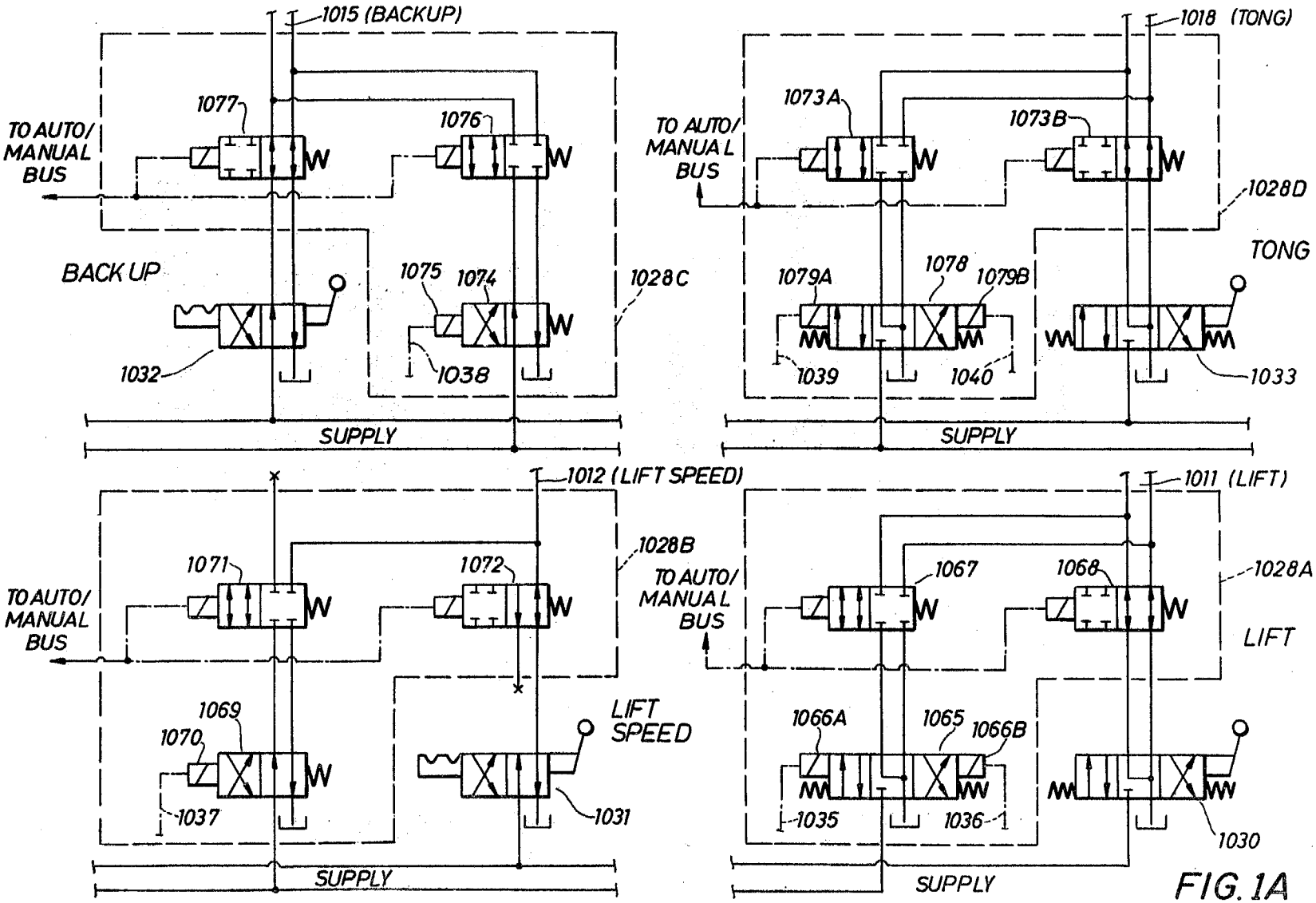
FIG. 1A is a detailed schematic diagram of an electrohydraulic interface embodying the teachings of this invention and disposed in a power tongs assembly in accordance with FIG. 1.
Figure 3A:
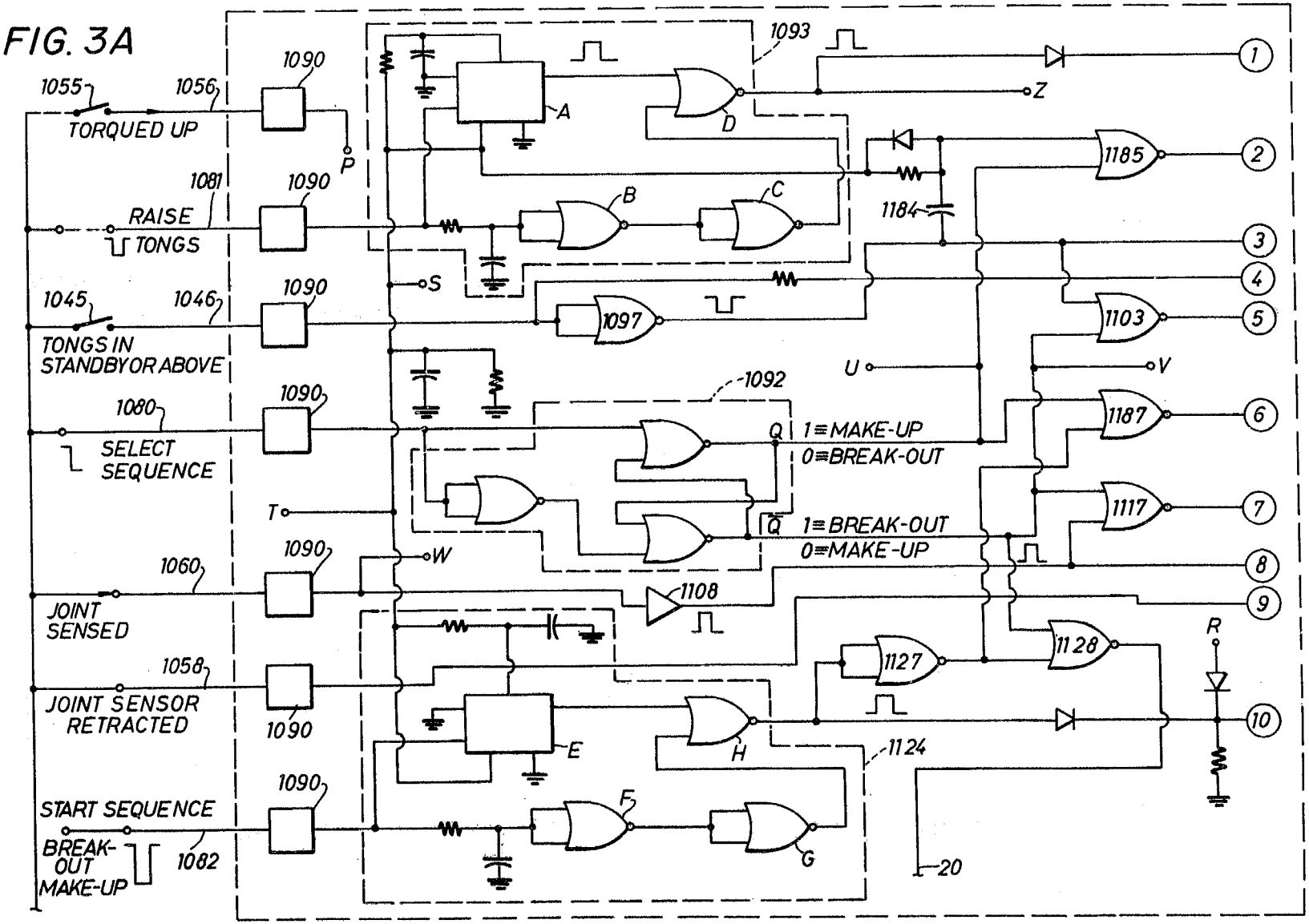
FIGS. 3A through 3D are detailed schematic diagrams of an automatic tongs control system embodying the teachings of this invention.
Figure 3B:
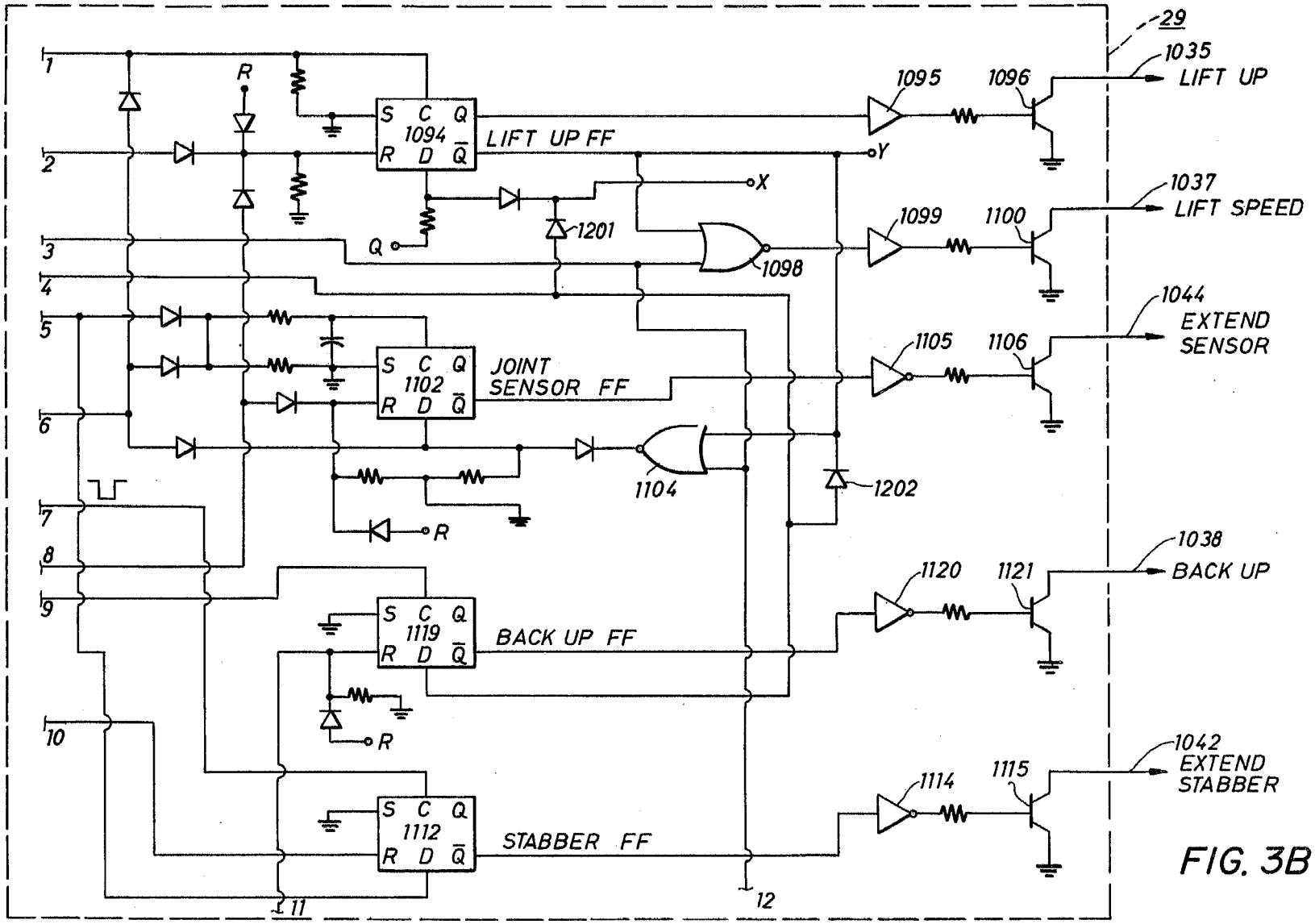
Figure 3C:
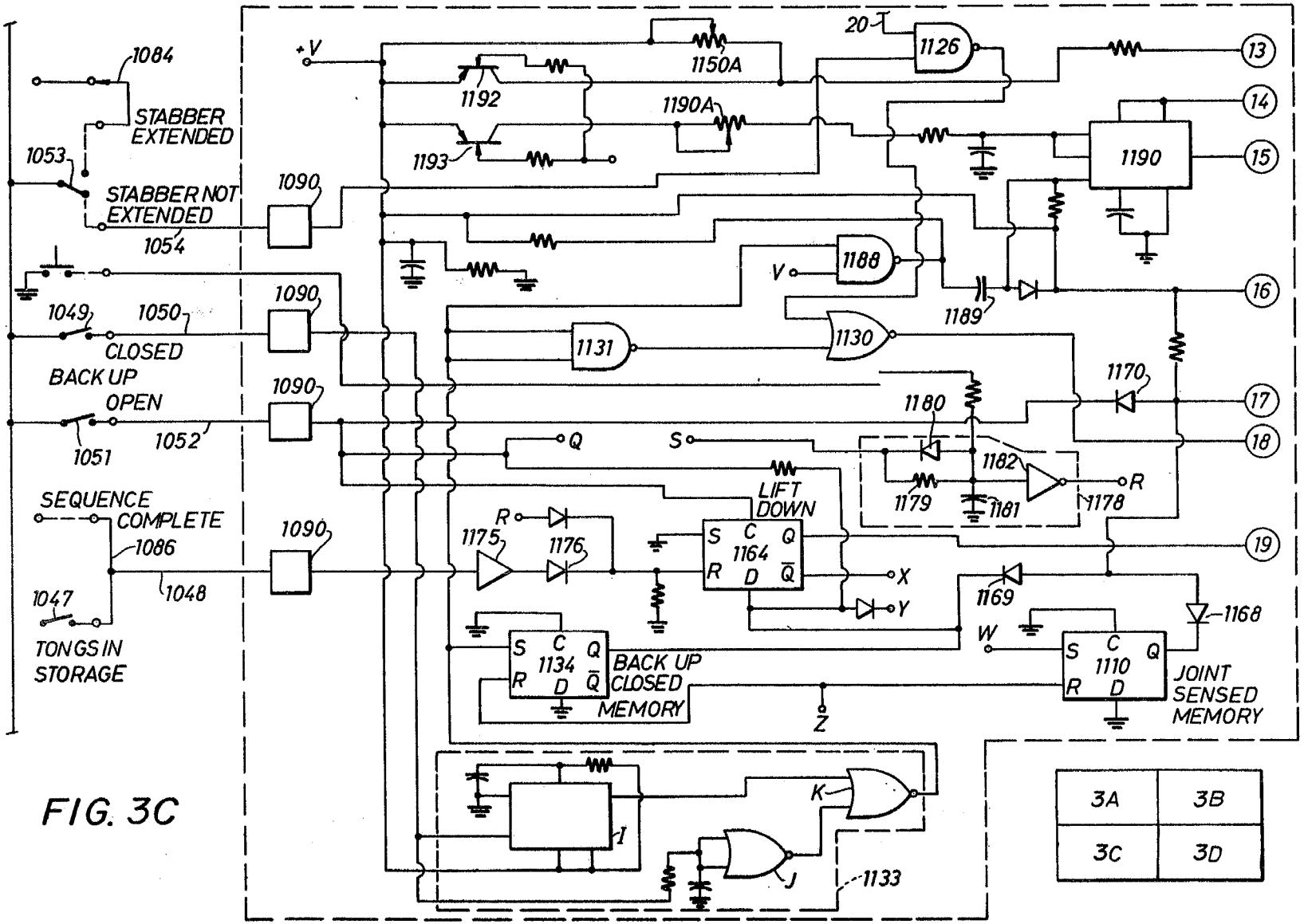
Figure 3D:
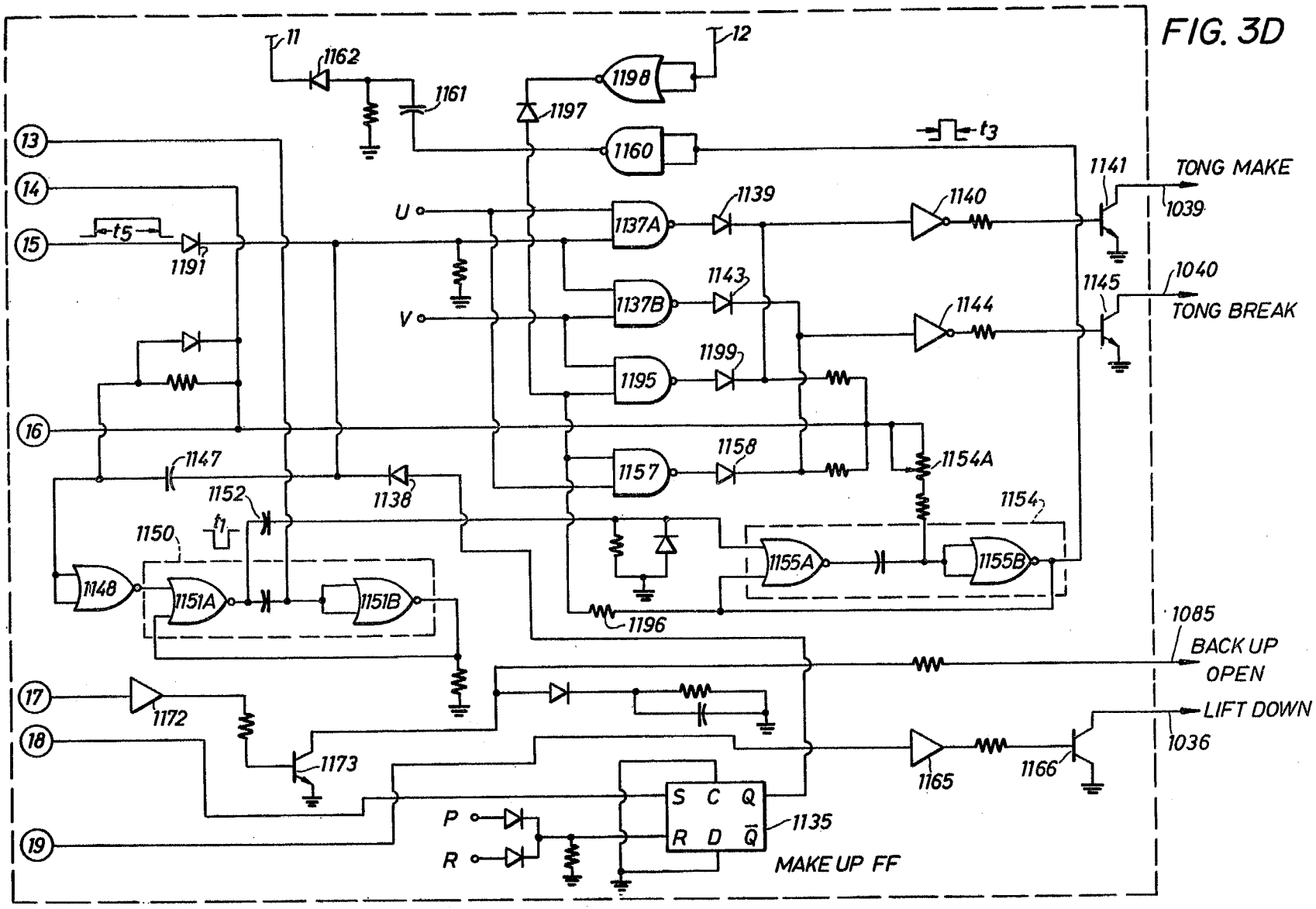

Referring now to FIG. 1A, a detailed schematic diagram of each of the interface modules 1028A through 1028D is shown. Each of the interface modules 1028 includes an electrically responsive solenoid valve adapted to control the flow of hydraulic fluid from a supply, or source, thereof to the respective user apparatus with which the interface module is associated. Whether the manually operated valve (and, therefore, the electrically responsive valve disposed within each interface) is a pilot valve (in the sense of initiating the operation of a larger valve) or is a control valve (in the sense of interdicting the flow of hydraulic fluid) is a design consideration dependent upon the particularities of a given tongs system. The electro-hydraulic interface module is an adjunct to the tongs control system 29 and is adapted to disenable the manually operated valve and replace it with an electrically responsive valve which performs the same function as performed by the manually operated valve. Thus, if the manually operated valve were a pilot valve, the electrically responsive valve in the interface would assume a pilot valve function. Alternatively, if the manually operated valve were a control valve, the electrically operated valve in the module would assume a control valve function. The electrically operated valve is connected in a parallel flow path to the manually operated valve. Further, each interface module 1028A through 1028D includes means, such as a select valve switch, disposed in series with the electrically responsive valve and with the manually operated valve to simultaneously disenable one of the valves and enable the other of the valves. The select valve switches may be manually or electrically operated, and are illustrated as electrically operated in connection with FIG. 1A.

The select valves or switches are all energized by the same source, namely the AUTO/MANUAL BUS from the tongs control system 29. The manual valves are enabled whenever the AUTO/MANUAL BUS is de-energized and the electrically responsive valves are disenabled. The electrically responsive valves are simultaneously enabled when the AUTO/MANUAL BUS is energizes all select valves.

As seen in the schematic diagram of the interface module 1028A, the four-way manually operated value 1030 with which the module is associated is also illustrated. An electrically responsive four-way solenoid valve 1065, connected in parallel relationship with the manually operated valve 1030, has solenoid coils 1066A and 1066B associated therewith. Connected in series with the electrically responsive valve 1065 is an AUTO-MANUAL SELECT valve switch 1067, while connected in series to the manually operated valve 1030 is an AUTO-MANUAL SELECT valve switch 1068. Actuation of all of the select valve switches simultaneously enables either the electrically responsive or manually operated valves and simultaneously disenables the other. The solenoid coil 1066A is connected to the electrical line 1035 (LIFT UP) from the tongs control system 29 while the solenoid coil 1066B is connected to the electrical line 1036 (LIFT DOWN) from the tongs control system 29. The presence of a signal on the line 1035 (LIFT UP) energizes the coil 1066A and lifts the tongs from the storage to the standby position. Analogously, the presence of a signal on the line 1036 (LIFT DOWN) energizes the coil 1066B and lowers the tongs from the standby to the storage position.

The interface module 1028B is associated with the manually operated valve 1031. An electrically responsive solenoid valve 1069 is connected in a parallel hydraulic path to the manually operated valve 1031. The valve 1069 has a solenoid coil 1070 associated therewith. AUTO/MANUAL SELECT valve switches 1071 and 1072 are, respectively, connected in series with the electrically responsive solenoid valve 1069 and the manually operated valve 1031 for purposes analogous to those discussed in connection with the select valve switches 1067 and 1068. The solenoid coil 1070 of the electrically responsive valve 1069 is connected to the electrical line 1037 (LIFT SPEED) output from the tongs control system 29. If the select valve switches 1071 and 1072 are disposed so as to simultaneously disenable the manually operated valve 1031 and enable the electrically responsive valve 1069, the presence of a signal on the line 1037 (LIFT SPEED) actuates the valve 1069 to regulate the speed at which the tongs are lifted from a first to a second elevation.

The interface module 1028C operates exactly as the structure described in connection with the module 1028B. An electrically responsive valve 1074 having a solenoid coil 1075 attached thereto is connected in a parallel hydraulic path to the manually operated valve 1032. AUTO/MANUAL SELECT valve switches 1076 and 1077 are respectively connected in series with the electrically responsive valve 1074 and the manually operated valve 1032. The solenoid 1075 is connected to the electrical line 1038 (BACKUP) from the tongs control system 29. If the select valve switches 1076 and 1077 are disposed so as to disenable the manually operated valve 1032 and to simultaneously enable the electrically responsive valve 1074, the presence of a signal on the line 1038 (BACKUP) from the tongs control system 29 actuates the valve 1074 to close the backup tong 1007.

The interface module 1028D is similar in configuration to that discussed in connection with the interface module 1028A. That is to say, a four-way electrically responsive solenoid valve 1078 having first and second solenoid coils 1079A and 1079B associated therewith is connected in a parallel hydraulic path to the four-way manually operated valve 1033. AUTO/MANUAL SELECT valve switches 1073A and 1073B are respectively connected in series to the electrically responsive valve 1078 and the manually operated valve 1033. The solenoid 1079A is connected to the line 1039 (TONG MAKE) from the tongs control system 29 while the solenoid 1079B is connected to the line 1040 (TONG BREAK) output therefrom. If the select valve switches 1073A and 1073B were disposed so as to simultaneously disenable the manually operated valve 1033 and enable the electrically responsive valve 1078, the presence of a signal on the line 1039 (TONG MAKE) actuates the electrically responsive valve 1078 to enable the tongs motor 1017 to makeu-up a joint of a drill string. The presence of a signal on the line 1040 (TONG BREAK) from the tongs control system 29 actuates the solenoid 1079B and energizes the tongs motor 1017 to breakout a drill string joint.

Since each of the four interface modules 1028 have substantially the same internal hydraulic circuitry and utilize substantially similar type valves, the same supply manifold may be utilized to reduce cost and provide a symmetrical electro-hydraulic interface assembly. The interface modules may be mounted on a common base and connected to common pressure and tank manifolds. A pressure-reducing valve and accumulator may, of course, be included to supply a constant pressure. Suitable hydraulic line tubing may be used to connect the valve manifolds and pressure-reducing valve to the common manifolds and to the input and output header plates of the electro-hydraulic interface.

The tongs control system 29 cannot equal the cycle times possible with the manual controls operated by experienced man. However, it does not make common mistakes such as forgetting to close the backup before rotating the tong, which sometimes happens with a man at the controls, or positioning the tong too-high or too-low on the tool joint. The cycle times of the tongs control system 29 are fast-enough, however. Since the tongs sequence is coordinated with the racker and drawworks sequences, the tongs cycle does not cause a delay in the overall program sequence.

POWER TONGS CONTROL SYSTEM

FIG. 3 is a detailed schematic diagram of a tongs control system 29 embodying the teachings of this invention. However, before embarking upon a detailed discussion of the circuitry of the tongs control system 29, reference is directed to FIG. 2 which illustrates the interconnections between the tongs control system 29 with the computer 40. The interconnections between the tongs control system 29 and the tongs structural system 28 have been discussed in connection with FIG. 1, but are reproduced on FIG. 2 for clarity. As seen from FIG. 2, the computer 40 outputs signals to the tongs control system 29 on a line 1080 (SELECT SEQUENCE), which signal represents a command from the computer 40 for the tongs control system 29 to execute either a make-up or a break-out cycle. The line 1081 (RAISE TONGS) carries a signal from the computer to the tongs control system 29 initiating the raising of the tongs along the vertical column 1001 (FIG. 1) from the storage to the standby position. A line 1082 (START SEQUENCE) carries a command signal from the computer 40 to the tongs control system 29 initiating the start of the selected sequence.

Upon the receipt of the START SEQUENCE signal on the line 1082, the circuitry of the tongs control system 29 initiates operation of the tong's physical structure to perform the operations necessary to either make-up or break-out a drill string. These command signals from the tongs control system 29 have been detailed in connection with FIG. 1. Some of the command signals, as discussed, must be interfaced through the electro-hydraulic interface shown in FIG. 1A. The tongs control system 29 is input with various feedback signals representative of the physical occurrence of certain actions within the tongs structure. These feedback signals from the means provided on the tongs structure have been detailed in connection with FIG. 1.

The tongs control system 29 outputs signals back to the computer. On the line 1084 (STABBER EXTENDED), an output signal is carried to the computer 40 indicating that the stabber (1009, FIG. 1) has been extended. This signal is meaningful only during the make-up sequence and provides information necessary to continue the pipe racker program. A line 1085 (BACKUP OPEN) carries information to the computer 40 representative of the fact that the backup tong 1007 is open. Finally, the tongs control system 29 outputs a signal on a line 1086 (SEQUENCE COMPLETE) representative of the fact that the selected cycle is complete and that the tongs have been returned to the storage position.

Figure 4A:
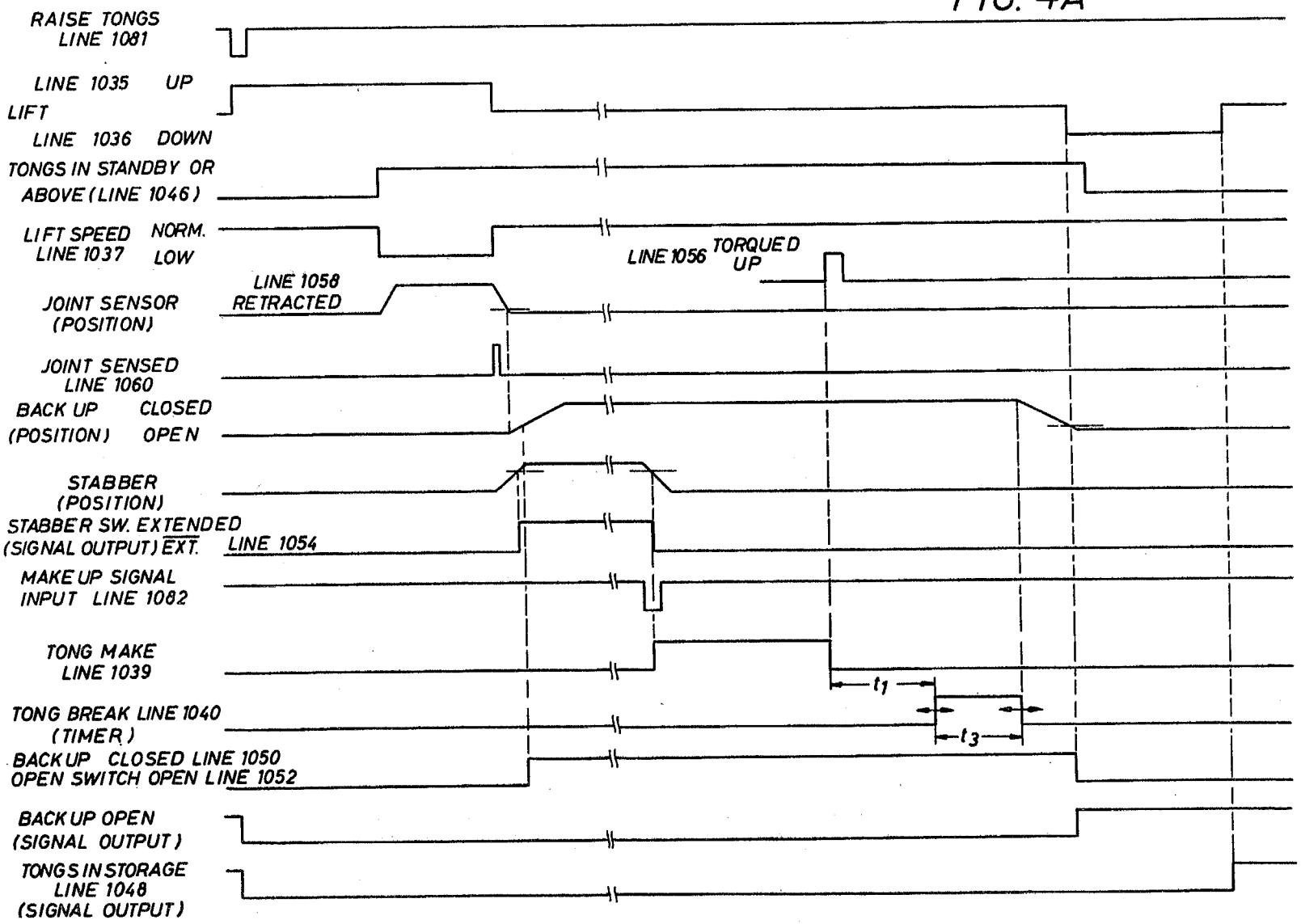
FIGS. 4A and 4B are timing diagrams for the automatic tongs control system shown in FIG. 3 in the make-up and breakout cycles, respectively.

Referring now to FIG. 3, a detailed schematic diagram of the tongs control system 29 is illustrated. The operation thereof may be more fully understood by reference to FIGS. 4A and 4B which are, respectively, timing diagrams for the tongs control system 29 shown in FIG. 3 in the make-up and break-out cycles.

In the overall computer controlled oil drilling rig embodying the teachings of this invention, the computer coordinates and sequences the operation of the tongs, drawworks and racker. The operating philosophy is to utilize a time-shared arrangement between the drawworks and racker control programs, with a minimum of interaction between the computer and the tongs. Basically, the computer initiates the selected tongs activity at the appropriate place in the cycle, with the activity being controlled by the tongs control system. Necessary signals from the tongs control to the computer to enable it to sequence the drawworks and racker are provided. When the tongs activity is completed a signal to this effect is sent to the computer.

It may also be noted that the control system shown in FIG. 3 is able to be utilized in connection with any power tongs structure due to the similarity of the operating elements. As discussed, all power tongs require a lift and lift speed controls, back-up tong controls, power driven tong controls, as well as initiation signals to a stabber (if one is provided) and an initiation signal for operation of a joint sensor. Thus, the control system disclosed herein is adaptable and useful with any power tongs. Although the initiating signals to the control system originate from a digital computer, it is understoood that the initiating instructions may be provided to the control system 29 through a push-button control box, thus making the control "manual" (in the sense that the sequencing signals to the tongs control originate from a human operator as opposed to a digital computer) but still "automatic" (in the sense that valves regulating the flow of pressurized fluid to the tongs structure are operated by the electrical signal outputs of the tongs control system.)

All of the feedback signals from the tongs structure 28 are applied to the tongs control 29 through filter elements 1090 as shown in FIGS. 13A and 13C. Each element 1090 contains a two-pole, low-pass filter to remove transients. It also contains a diode limiter to limit the magnitude of the input signal to a level compatible with the succeeding logic components.

In a make-up cycle, the signal from the computer on the line 1081 (RAISE TONGS) provides a logic signal to raise the tongs to the standby position. The RAISE TONGS signal on the line 1081 is filtered and limited, as discussed above, and applied to a delay circuit 1093 including a multivibrator A, inverters B and C, and a NOR gate D. The delay circuit 1093 provides a predetermined delay so that the duration of an incoming signal on the line 1081 must last at least the predetermined delay interval (for example, 0.3 seconds) before it is passed into the control logic. The delay 1093 provides additional protection against line transients causing a false signal.

The output of the delay circuit 1093, and specifically the output of the NOR gate D, clocks a LIFT UP flip-flop 1094. When clocked, the Q output of the LIFT UP flip-flop 1094 goes to a logic 1 and that signal is amplified by an amplifier 1095 and applied to a transistor 1096 causing it to conduct. The output signal on the line 1035 (LIFT UP) is applied to the E.H.I. 1028A to raise the tongs in an upward direction from the storage toward the standby position. The output of the delay network 1093 also resets the BACKUP CLOSED MEMORY flip-flop and the JOINT SENSED MEMORY flip-flop, as illustrated by the reference characters Z—Z.

At the standby position, a feedback signal on the line 1046 (from the upper limit switch 1045 (FIG. 1) generates a LIFT SPEED signal on the line 1037 to shift the speed of the upward motion of the tongs to slow. The output signal on the line 1037 (LIFT SPEED) is derived through an inverter 1097, a NOR gate 1098, an amplifier 1099 and a transistor 1100. The NOR gate 1098 derives its other input from the $\overline{Q}$ output of the LIFT UP flip-flop 1094. The same signal from the output of the inverter 1097 clocks a JOINT SENSOR flip-flop 1102. The clock signal is derived from a NOR gate 1103 which derives its inputs from the $\overline{Q}$ output of the network 1092 and the output of the inverter 1097, both of which are at logic 0 at this time. The data input to the flip-flop 1102 is derived from the output of a NOR gate 1104. The inputs to the gate 1104 (both of which are at logic 0 at this time) are derived from the output of the inverter 1097 and from the $\overline{Q}$ output of the LIFT UP flip-flop 1094. The $\overline{Q}$ output of the flip-flop 1102 is applied through an inverter 1105 and a transistor 1106 to the line 1044 (EXTEND SENSOR) to extend the joint sensor 1025 (FIG. 1). The sensor 1025 is extended only when the tongs are being lifted and only when the tongs are above the standby position.

The slow upward motion of the tongs continues until a JOINT SENSED feedback signal is received from the joint sensor 1025 on the feedback line 1060.

The JOINT SENSED feedback signal on the line 1060 generates several responses within the tongs control network 29. The signal on the line 1060, after appropriate filtering and limiting, resets the LIFT UP flip-flop 1094 through an amplifier 1108 to thereby stop the upward motion of the tongs. A JOINT SENSED signal also resets the JOINT SENSOR flip-flop 1102, again derived through the amplifier 1108, to retract the joint sensor 1025. Thirdly, the JOINT SENSED signal on the line 1060 sets a JOINT SENSED flip-flop memory 1110 as illustrated by reference characters W—W. Finally, the JOINT SENSED signal on the line 1060 causes the stabber 1109 (FIG. 1) to extend by clocking a STABBER flip-flop 1112 which applies a signal through an inverter 1114 and a transistor 1115 to the line 1042 (EXTEND STABBER). The STABBER flip-flop is clocked through a NOR gate 1117. The NOR gate 1117 derives its inputs from the output of the amplifier 1108 and from the $\overline{Q}$ output of the Schmitt trigger network 1092.

The receipt of a JOINT SENSOR RETRACTED signal on the line 1050 from the limit switch 1057 (FIG. 1) clocks a BACKUP flip-flop 1119. The output of the BACKUP flip-flop 1119 generates a signal on the output line 1038 (BACKUP) through an inverter 1120 and a transistor 1121 to close the backup tong 1007. A feedback signal STABBER EXTENDED from the switch 1053 is output on the line 1084 to the computer 40.

At this point in the sequence there is a pause until a signal is received on the line 1082 (START SEQUENCE) from the computer (FIG. 2) commanding that the joint make-up sequence be started. This signal is conducted through a delay circuit 1124 comprising a multivibrator E, inverters F and G and a NOR gate H. The delay network 1112 acts to impose a predetermined delay (for example, 0.3 seconds) such that the interval of any incoming signal on the 1082 must be at least 0.3 seconds in duration before it is passed. The output of the delay network 1124, and specifically the NOR gate H, resets the STABBER flip-flop 1112, retracting the STABBER 1109 (FIG. 1). The output signal from the delay circuit 1124 provides one input to an AND gate 1126 through an inverter 1127 and a NOR GATE 1128. The NOR gate 1128 derives its inputs from the inverter 1127 and from the $\overline{Q}$ output of the bistable network 1092. The second input to the AND gate 1126 is derived from a feedback signal from the switch 1053 on the line 1054 indicating that the stabber is not extended.

The output of the AND gate 1126 is applied to a NOR gate 1130 which derives its other input from an inverter 1131. The inputs to the inverter 1131 are derived from a feedback signal on the line 1058 (BACKUP CLOSED) from the limit switch 1049 (FIG. 1). The input on the line 1058 (BACKUP CLOSED) is applied to a delay circuit 1133 for reasons similar to those discussed above. The delay circuit 1133 includes a multivibrator I, an inverter J, and a NOR gate K. The output of the delay network 1133 is applied to the inverter 1131 and also sets a BACKUP CLOSED MEMORY flip-flop 1134.

The output of the NOR gate 1130 sets a MAKE-UP flip-flop 1135. The Q output of the MAKE-UP flip-flop 1135 enables the appropriate one (1137A) of the NAND gates 1137A and 1137B through a diode 1138. The second input to the NAND gate 1137A is derived from the Q output of the bistable network 1092 as illustrated by the reference characters U—U. The second input to the NAND gate 1137B is derived from the $\overline{Q}$ output of the network 1092 as illustrated by the reference characters V—V.

The output of the enabled NAND gate 1137A is applied to the line 1039 (TONG MAKE) through a diode 1139, an inverter 1140, and a transistor 1141. This causes the jaws of the power driven tong to close and to rotate clockwise to make-up the joint. The output of the NAND gate 1137B, which is not enabled during the make-up mode, is applied to the line 1040 (TONG BREAK) through a diode 1143, an inverter 1144 and a transistor 1145. The tongs motor 1017 is rotated until a TORQUED UP signal on the line 1056 is received from the feedback means 1055 on the makeup cylinder (illustrated as a switch in FIG. 3A). The signal on the line 1056 (TORQUED UP) resets the MAKE-UP flip-flop 1135, as illustrated by the reference characters P—P, which stops the tongs motor rotation. As the Q output from the MAKE-UP flip-flop 1135 goes low, a pulse is applied through a capacitor 1147 and an inverter 1148 to initiate a timer 1150 ($t_1$) comprising NOR gate 1151A and an inverter 1151B. The output of the timer 1150 provides an adjustable delay $t_1$ (see timing diagram, FIG. 4A), the period of which is set by a potentiometer 1150A.

When the time $t_1$ runs out, a pulse through a capacitor 1152 inititates a second timer 1154 comprising NOR gates 1155A and an inverter 1155B. This timer 1154 (set by a potentiometer 1154A) provides an adjustable time $t_3$ during which the electrically controlled solenoid valve 1077 connected by the line 1040 (TONG BREAK) in the interface module 1028A (FIG. 1A) is energized through a resistor 1196 and a NAND gate 1157, a diode 1158, the inverter 1144 and the transistor 1145. This signal on the line 1040 reverses the tongs motor 1017 so that it rotates clockwise to open the jaws of the power driven tong 1008. The second input to the NAND gate 1157 is derived from the Q output of the Schmitt trigger network 1092 as illustrated by reference characters U—U. When time $t_3$ runs out, the signal on the line 1040 terminates, de-energizing the transistor 1017. At the same time, a pulse is applied through an inverter 1160, a capacitor 1161 and a diode 1162 to reset the BACKUP flip-flop 1119 which causes the backup tong 1007 to open.

A signal on the line 1052 (BACKUP OPEN) from the switch 1051 (FIG. 1) clocks a LIFT DOWN flip-flop 1164. The Q output (a logic 1) of the LIFT DOWN flip-flop 1164 is applied to the line 1036 (LIFT DOWN) through an amplifier 1165 and a transistor 1166 to lower the tongs. In addition, the signal on the line 1052 (BACKUP OPEN) is AND-ed with two other signals through diodes 1168, 1169 and 1170. The BACKUP OPEN signal is applied on the output line 1085 through the amplifier 1172 and transistor 1173 only if the JOINT SENSED MEMORY flip-flop 1110 and the BACKUP CLOSED MEMORY flip-flop 1134 have both been previously set. Therefore, the BACKUP OPEN signal output on the line 1085 to the computer is inhibited unless the tongs have been cycled through the major phases of their operational sequence.

As the tongs approach the storage position, the lower limit switch 1047 (FIG. 1) outputs a signal on the line 1048 to the tongs control system 29. This signal is applied through an amplifier 1175 and a diode 1176 to reset the LIFT DOWN flip-flop 1164.

Resetting of the LIFT DOWN flip-flop 1164 stops the tongs lowering motion. A signal from the lower switch 1047 is also applied to the line 1086 (SEQUENCE COMPLETE) indicating that the tongs sequence is completed (FIG. 2). It signifies to the computer that the tongs are clear of any potentially obstructing position with the elevator to permit the elevator to be lowered to the desired elevation.

A delay network 1178 (FIG. 3C) consisting of a resistor 1179, a diode 1180, a capacitor 1181 and an inverter 1182 function to reset all flip-flops as illustrated by reference characters R—R when system power is applied. It insures that all logic components are preset to the proper state at the beginning of the sequence.

Figure 4B:
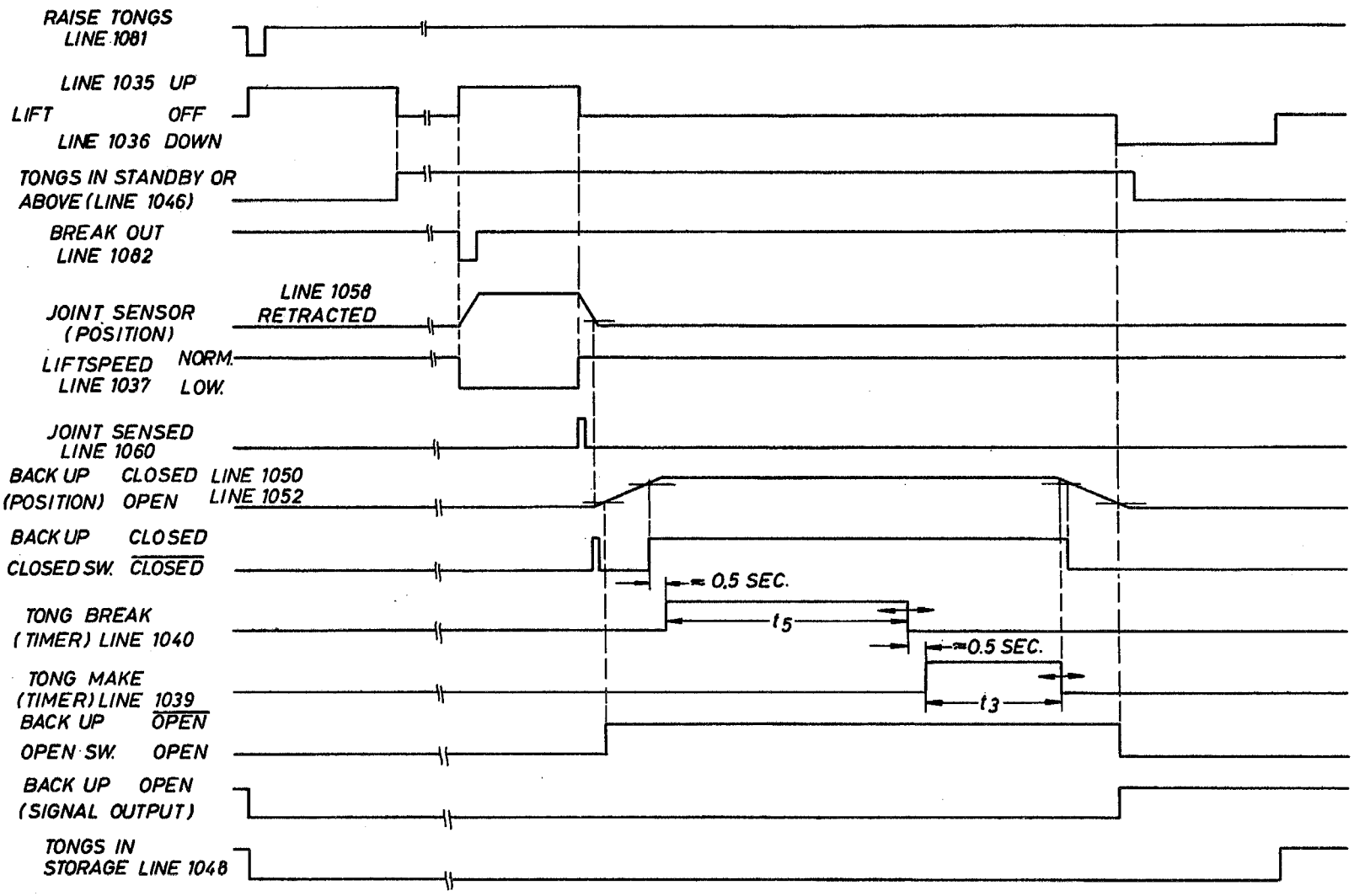

The timing diagram for a break-out cycle is shown in FIG. 4B. During a break-out cycle, a logic 1 signal on the line 1080 (SELECT SEQUENCE) from the computer 40 transfers the logic circuits to the proper configuration. Namely, the Q output of the Schmitt trigger network 1092 is in a logic 0 condition while the $\overline{Q}$ output thereof is in a logic 1 condition. A RAISE TONGS signal on the line 1081 sets the LIFT UP flip-flop 1094 raising the tongs, as previously discussed. The lifting motion of the tongs is halted by a feedback signal from the upper limit switch 1045 (FIG. 1) on the line 1046 which is inverted the by inverter 1097, and coupled through a capacitor 1184 and a NOR gate 1185 to reset the LIFT UP flip-flop 1094. A pause in the tong sequence follows with the tongs remaining in the standby position.

When the tool joint is hoisted into position, a break-out signal is applied on the line 1082 (START SEQUENCE) through the delay network 1124. The output of the delay network 1124 clocks the JOINT SENSOR flip-flop 1102 through an inverter 1127 and a NOR gate 1187 to extend the joint sensor 1025. The other input to the NOR gate 1187 is derived from the Q output of the bistable network 1092. The output of the delay network 1124 also clocks the LIFT UP flip-flop 1094, again through the inverter 1127 and NOR gate 1187.

The $\overline{Q}$ output of the LIFT UP flip-flop 1094 is NOR-ed at the gate 1098 with the signal from the upper limit switch 1045 on the line 1056 as inverted by the inverter 1097. The output of the NOR gate 1098 is applied through the amplifier 1099 and applied to the transistor 1100 which switches to a conductive state. The output signal on the line 1037 (LIFT SPEED) switches the tongs lifting motion to a speed slow enough to detect the joint. The joint sensor is extended when the JOINT SENSOR flip-flop 1102 is clocked by a signal from the output of the NOR gate 1103. The NOR gate 1103 derives its inputs from the output of the inverter 1097 and the $\overline{Q}$ output of the bistable network 1092.

As the tongs reach the desired elevation, a JOINT SENSED feedback signal on the line 1060 from the joint sensor 1025 is received. The JOINT SENSED signal resets the LIFT UP flip-flop 1094 through the amplifier 1108 to stop the lift motion of the tongs. The JOINT SENSED feedback signal also sets the JOINT SENSED MEMORY flip-flop 1110 as illustrated by the reference characters W—W. The JOINT SENSED feedback signal also resets the JOINT SENSOR flip-flop 1102 through the amplifier 1108 to retract the joint sensor 1025. The retraction of the joint sensor 1025 generates a feedback signal on the line 1058 to clock the BACKUP flip-flop 1119.

A signal from the feedback switch 1049 on the line 1058 (BACKUP CLOSED) is applied to the delay network 1133 to prevent any initial transients as the backup starts to close from appearing as a true signal. The output of the delay network 1133 sets the BACKUP CLOSED MEMORY flip-flop 1134. The output of the delay network 1133 is also applied to a NAND gate 1188. The second input to the NAND gate 1188 is derived from the $\overline{Q}$ output of the Schmitt trigger network 1092 as illustrated by the reference characters V—V. The output of the NAND gate 1188 is coupled through a capacitor 1189 to a timer 1190. The duration of the output of the timer 1190 is an adjustable time delay $t_5$ (FIG. 4B) set by a potentiometer 1190A. The output of the timer 1190 is connected through a diode 1191 and switches the properly enabled NAND gate. In this case the enabled gate, 1137B, derives its second input from the $\overline{Q}$ output of the bistable network 1092 as illustrated by reference characters V—V. A signal is applied to the line 1040 (TONG BREAK) through the diode 1143, the inverter 1144 and the transistor 1145 to the tongs motor 1017 to break out the joint by counter-clockwise rotation.

When the timer 1190 times out, the tongs motor 1017 is de-energized and a pulse is coupled through the capacitor 1147 and the inverter 1148 to start the $t_1$ timer 1150. During the break-out cycle the transistors 1192 and 1193 are conducting so that the potentiometer 1150A which normally sets the duration of $t_1$ is bypassed. A long delay is unnecessary in the break-out mode. When the $t_1$ timer 1150 times out, a pulse is coupled by a capacitor 1152 to initiate the $t_3$ timer 1154. The output of the $t_3$ timer 1154 is applied to a NAND gate 1195 through a resistor 1196. This input to the NAND gate 1195 is also coupled from the output of the inverter 1097 through a diode 1197 and an inverter 1198. The second input of the NAND gate is connected to the $\overline{Q}$ output of the Schmitt trigger network 1092 as illustrated by reference characters V—V.

When the output of the $t_3$ timer 1154 is applied to the NAND gate 1195, its output switches to logic 1 and this is applied through a diode 1199 and the amplifier 1140 to the line 1039 (TONG BREAK). This energizes the tongs motor 1017 (FIG. 1) for the time period $t_3$ in a clockwise direction so as to open the jaws of the power driven tong 1008.

When the $t_3$ timer 1154 is timed out, a pulse is coupled through the inverter 1160, the capacitor 1161 and the diode 1162 to reset the BACKUP flip-flop 1119. This opens the jaws of the backup tong 1007. A signal on the line 1052 (BACKUP OPEN) from the switch 1051 clocks the LIFT DOWN flip-flop 1164 to return the tongs to the storage position. This signal (BACKUP OPEN) is applied through the diode 1170 to the amplifier 1172 along with enabling signals through the diodes 1168 and 1169 to switch the transistor 1173 on. This output signal on the line 1085 (BACKUP OPEN) is applied to the computer only if the previously discussed preconditions have been met. This signal to the computer 40 signifies that the pipe stand is ready to be moved to its storage position.

When the tongs reach the storage position the switch 1047 outputs a signal on the line 1048 (TONGS IN STORAGE) to reset the LIFT DOWN flip-flop 1164 halting the motion and a signal on the line 1086 (SEQUENCE COMPLETE) is output to the computer indicating that the tongs sequence is complete.

The diodes 1201 and 1202 prevent the BACKUP flip-flop 1119 from being clocked while the tong lift is in motion. Conversely, the BACKUP OPEN signal on the line 1052 is applied as an enabling signal to the data input of the LIFT UP flip-flop 1094 as illustrated by reference charaters Q—Q and the data input of the LIFT DOWN flip-flop 1164. Neither flip-flop may be clocked unless the backup is open. This prevents tongs lift motion unless the backup is open.

JOINT SENSOR

Figure 5A:
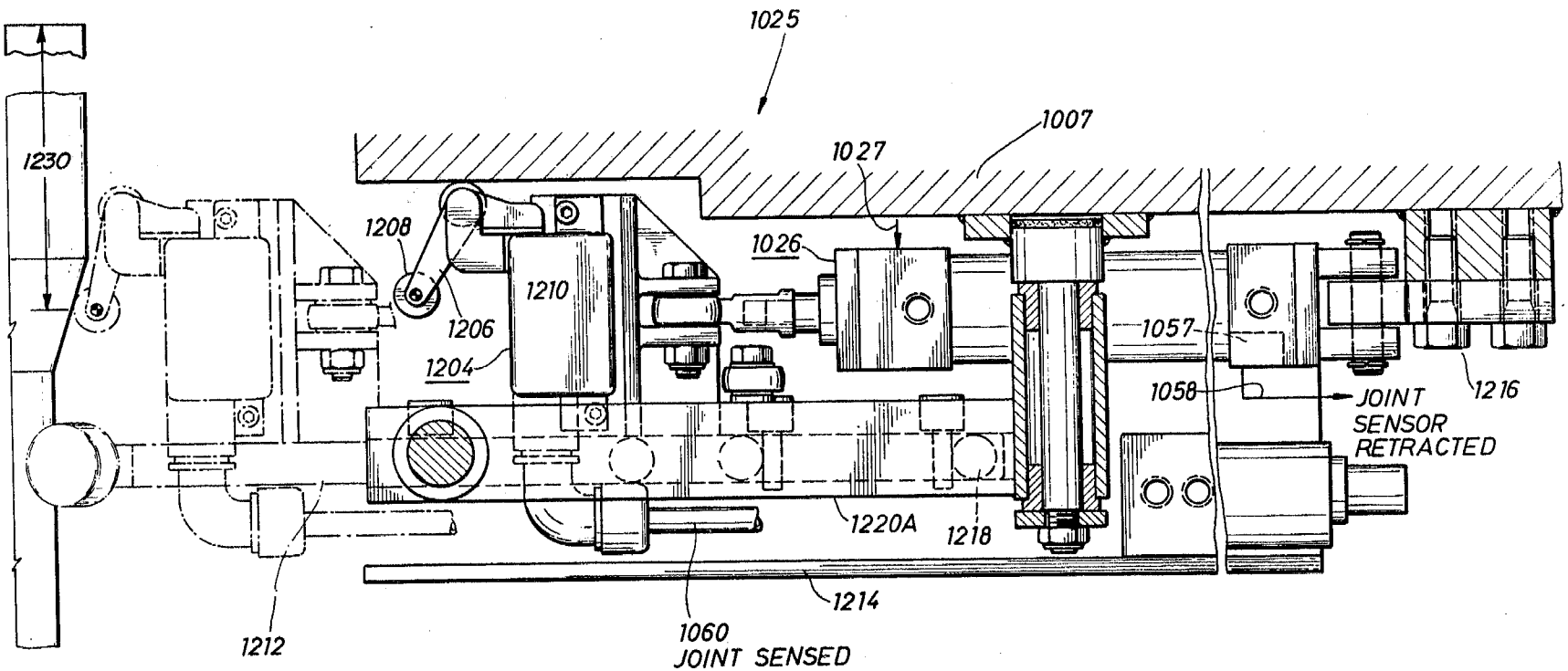
FIGS. 5A and 5B, are, respectively, detailed elevation and top views of a joint sensor for a power tongs assembly in accordance with the teachings of this invention; and, FIG. 6 is a definitional diagram of two commonly used drill pipe configurations illustrating the structure thereof to assist in the description of the joint sensor shown in FIGS. 5A and 5B.
Figure 5B:
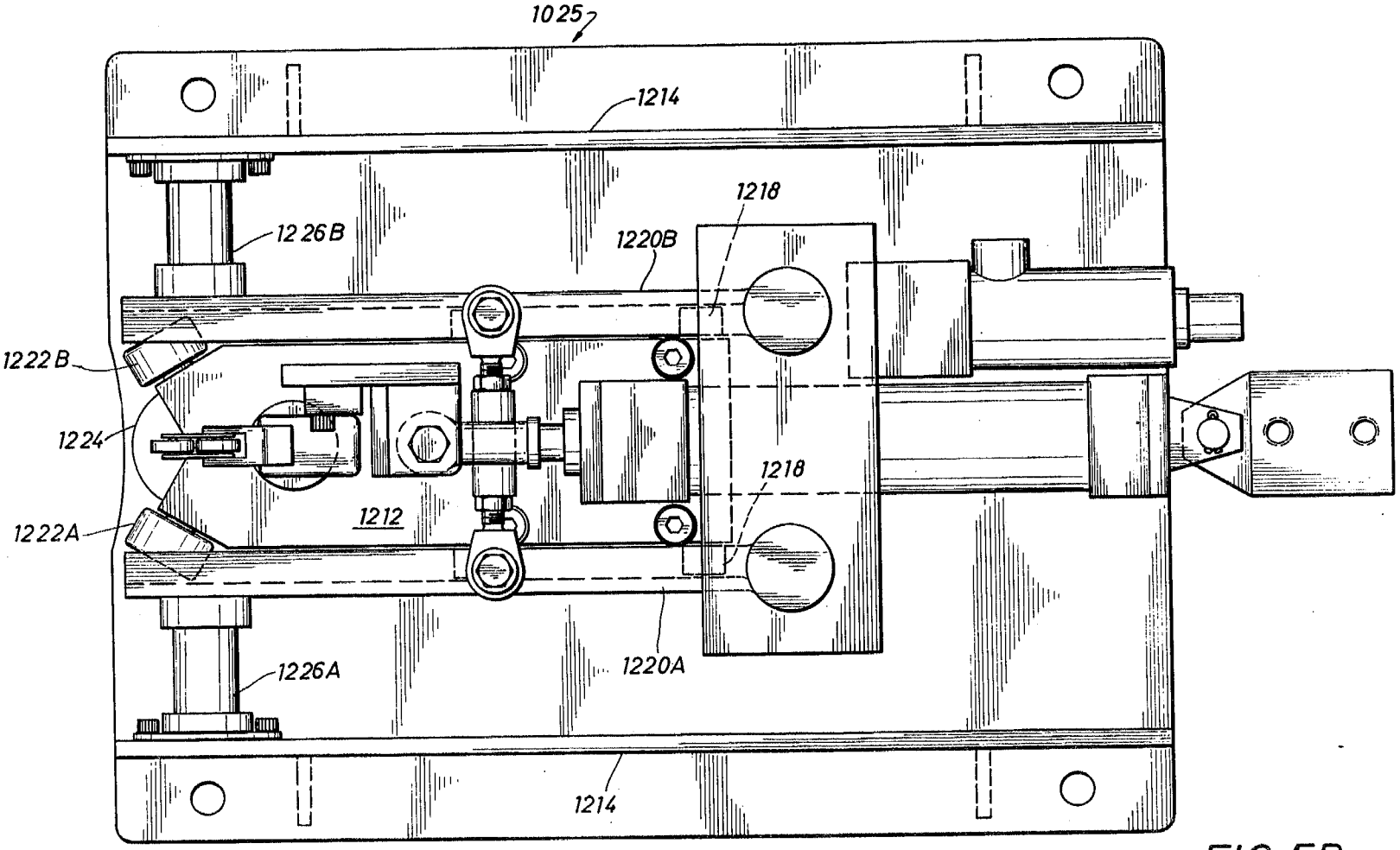

Referring to FIGS. 5A and 5B, respectively shown are side elevational and top views of a joint sensor generally indicated by reference numeral 1025 embodying the teachings of this invention. The joint sensor 1025 is attached beneath the backup tong 1007 of a power tongs assembly (FIG. 1) and is operative to accurately position the backup tong 1007 and a driven tong 1008 in a symmetrical relationship with the tool joint being made-up or broken-out by the tongs 1000 under the control of the tongs control system 29. Since the gripping space for the tongs dies is limited, and since considerable force must be applied to these dies, it is necessary to locate the backup tong 1007 and the driven tong 1008 as nearly as possible in vertical symmetry above and below a horizontal plane extending through the tool joint.

The joint sensor 1025 includes a sensor arrangement 1204 which comprises an arm 1206 having a roller 1208 thereon, the roller being contactable with a drill pipe and the arm being pivotally moveable with respect thereto from a first, normal, position to a second, deflected, position. The detector arrangement 1204 also comprises means 1210, including the limit switch 1059, associated with the arm 1206 for generating an electrical signal on the output line 1060 (JOINT SENSED) when the arm 1206 is pivotally deflected a predetermined angular distance from the normal position by being brought into contact with a distended location on the pipe. The arm 1206 is biased into the normal position by an internal spring assembly (not shown). The means 1210 may be any suitable commercially available assembly, such as that sold by Micro under model number BZLN-2-RH.

In FIGS. 5A and 5B, the joint sensor arrangement 1204 of the sensor 1025 is mounted on a carriage 1212 disposed for movement within a suitable housing 1214. The housing 1214 is connectable by any suitable attachment arrangement 1216 to the underside of the backup tong 1007. Disposed within the housing 1214 is a piston-cylinder arrangement 1026 (FIG. 1). The piston-cylinder arrangement is in fluid communicaion with the line 1027 illustrated diagrammatically in FIG. 5A, the line 1027 carrying a fluid (such as pressurized air) which when provided to the cylinder extends the joint sensor from a first, horizontally retracted, position to a second, horizontally extended, position. Included with the piston-cylinder 1026 is the limit switch 1057 which outputs an electrical signal on the line 1058 (JOINT SENSOR RETRACTED) to the tongs control system 29 when the sensor 1204 is in the horizontally retracted position. The cylinder 1026 may provide a stroke greater than is necessary to extend the sensor 1024 to contact the pipe whose joint is to be sensed to provide an additional ability to follow any longitudinal misalignments of the pipe or irregularities in its surface, as with pipes exhibited an external upset (FIG. 6). The pressure of the pressurized air in the line 1027 is sufficient to hold the extended sensor 1204 in position against the pipe. It is most advantageous to use a compressible fluid, as pressurized air, so that the pressurized air in the piston-cylinder 1026 acts as a spring to allow movement of the sensor 1204 after it is extended.

The carriage 1212 has horizontal roller elements 1218 engageable with guide rails 1220 mounted within the housing 1214. The horizontal rollers 1218 are provided to facilitate the horizontal movement of the sensor 1204 and carriage 1212 therefor in response to actuation of the pistoncylinder 1026.

In one embodiment of the invention, the carriage 1212 is provided with a pair of guide rollers 1222A and 1222B. As shown in FIG. 5B, the axes of rotation of each of the guide rollers 1222 define a predetermined angle 1224 of aproximately 120 degrees therebetween. The angularity between the guide rollers 1222 assists in centering the sensor 1204 laterally with respect to the pipe. Centering spring 1226A and 1226B are also provided between the guide rails 1220 and the housing 1214 to permit the guide rollers 1222 to align the sensor 1204 with the pipe even though the pipe may not be centered within the tongs. In an alternate embodiment of this invention, the guide roller 1222 and the detector roller 1208 may each be of a predetermined lateral dimension and in a parallel relationship so as to be able to contact the pipe regardless of the centered orientation thereof with respect to the tongs. In such a structural embodiment, the carriage 1212 is moved horizontally from the retracted to the extended position by the piston-cylinder 1026 and lateral centering of the sensor 1204 on the pipe is not required.

In operation, the sensor roller 1208 moves with the tongs slowly upwardly until the arm 1206 is pivotally deflected from its normally outwardly biased position against the surface of the pipe by a distended surface feature on the pipe. With reference to FIG. 6, it is there shown that dependent upon the pipe utilized, any one of a predetermined number of distended portions on the pipe may be used to actuate the sensor arrangement embodying the teachings of this invention. The location on the box end taper (FIG. 6) having a predetermined diameter of approximately 5.70 inches when using 5.00 inch drill pipe, is such a convenient location on the pipe. When the predetermined location on the pipe is encountered by the sensor roller 1208 and the arm 1206 is pivotally deflected from the normal position, the switch 1059 emits an electrical signal on the line 1060 that the joint has been sensed. When the predetermined location on the pipe is encountered, the distance 1230 from that location to the joint is a known value. As discussed in connection with the tongs control system 29 in FIG. 3, the lift is stopped, the sensor is retracted, and the backup tong 1007 is locked.

Due to the standarization of drill pipes in the oil drilling industry, detection of a predetermined location, such as a predetermined diameter on the box end taper, insures that any other surface feature on the pipe, such as the joint itself, is then a predetermined known distance 1230 from the location which generated the deflection signal. Thus, it is insured that the tongs is in the operating position, that the backup tong and the driven tong are vertically symmetrical with respect to a horizontal plane through the pipe joint and that the joint may be madeup or broken-out by the tongs.

With reference to FIG. 6, shown are views of standard drill pipe stands having the commonly named portions thereof indicated as shown. One end of the stands includes a threaded male member while the opposite end thereof is an internally threaded female member. Normally, the pipe stand is inserted into the drill string such that the male end of each stand is inserted into the bore before the female end thereof. The male end of the next-to-be engaged stand is then connected by a power tongs to the female member of the last-inserted stand protruding from the bore.

At both the male and female ends of the stand, below the tool joint outer diameter, a taper portion known as the box end taper and the pin end taper, respectively, is provided on the female and male ends of the stands. Depending upon whether an internal or external upset is provided, further tapering of the drill pipe stand may occur. The basic difference between an internal and external upset pipe stand is illustrated in FIG. 6. Basically, an internally upset pipe presents a constant outer diameter between each of the end tapers while an externally upset pipe exhibits an upset taper on the exterior of the pipe stand. In order to accommodate either internally or externally upset pipe stands, the joint sensor 1025 embodying the teachings of this invention is operative to emit a signal when the roller 1208 and arm 1206 thereof comes into abutting contact with and is deflected by a predetermined location on the box end taper. Of course, any predetermined location on the end taper sections, either on the internally or externally upset pipe stand, may be detected by a joint sensor 1025 embodying the teachings of this invention. The program listing for use with the instant invention is disclosed in U.S. Pat. No. 4,128,888, the disclosure of which is hereby incorporated by reference.

Having described a preferred embodiment of the invention, those skilled in the art may appreciate that modifications may be imparted thereto yet remain within the scope of the appended claims.

What is claimed is:

1. Apparatus for controlling a tongs arrangement having (a) a tongs lift, (b) means for controlling the lift speed, (c) a backup tong, and (d) a power driven tong, said apparatus comprising:

means for generating a signal to lift the backup and the power driven tong at a predetermined speed to a predetermined elevation;

means for generating a first feedback signal representative of the tongs being disposed at the predetermined elevation;

means responsive to the first feedback signal for generating a signal to close and lock the backup tong when it is lifted to the predetermined elevation;

means for generating a second feedback signal representative of the closure and locking of the backup tong; and, means responsive to the second feedback signal for generating a signal to drive the power driven tong when the backup tong is closed and locked.

2. Apparatus for making a breaking joints between adjacent lengths of pipe including a driven tong, a backup tong, means for moving said driven and backup tongs along the axis of a pipe, and drive means for actuating said driven tong to make-up or break-out a joint between adjacent lengths of pipe; characterized by a tongs control system including:

means, operatively connected to said tongs, and selectively extendable toward the axis of a pipe within said tongs, for sensing a joint between adjacent lengths of pipe;

means for activating said tongs moving means to move said tongs along the axis of a pipe located therein and for deactivating said moving means when said sensing means senses a portion of a pipe joint indicative of the operating position of said driven and backup tongs along the pipe axis relative to the pipe joint;

means for closing said backup tong in gripping engagement with a length of pipe therein, near a joint sensed by said sensing means, in response to such sensing by said sensing means; and means for actuating said drive means in response to actuation of said closing means to make-up or break-out the joint sensed by said sensing means.

3. Apparatus according to claim 2 further comprising:

means for retracting said sensing means when the latter senses a portion of a pipe joint indicative of the position of said tongs along the pipe axis relative to the joint.

4. Apparatus according to claim 3 further comprising:

means operatively connected to said tongs moving means for moving said tongs along the axis of the pipe at a first velocity until said tongs reach a standby reference position and at a second velocity from said standby reference position to said tongs operating position.

5. Apparatus according to claim 4 further comprising:
means operatively connected to said sensing means to permit extension of said sensing means toward the axis of the pipe when said tongs moving means moves said tongs past said standby reference position.

6. Apparatus according to claim 5 further comprising:
means operatively connected to said sensing means to extend a stabber to guide an upper length of drill pipe into a lower length of drill pipe when said tongs are disposed in said operating position.

7. Apparatus according to claim 2 further comprising:
means for deactuating said drive means when the make-up or break-out of the joint sensed by said sensing means is effected.

8. A tongs arrangement for making and breaking a joint between lengths of pipe, said tongs arrangement including: a backup tong; a driven tong; means for lifting and lowering the backup and driven tongs; and a motor for actuating the driven tong to effect the make-up and break-out of a pipe joint between two lengths of pipe, characterized by a tongs control system including:
means forming an electrical network for selectively generating, conducting, and transmitting electrical signals to effect the make-up or breakout of a joint between two lengths of pipe;
means, operatively connected to said tongs lifting and lowering means, for generating a first output signal within said network to actuate said lifting and lowering means to lift said tongs from a first, storage position and for generating a first feedback signal within said network to stop said lifting and lowering means when said tongs are lifted to a second, predetermined operating position;
means for sensing the joint between two adjacent lengths of pipe, said sensing means being selectively extendable and retractable relative to a length of pipe within said tongs;
first electrical feedback signal generating means, operatively connected to said network and actuated by said joint sensing means when the latter senses a portion of a joint indicative of the disposition of the backup and driven tongs with respect to the joint sensed, for initiating retraction of said joint sensing means;
means, operatively connected to said joint sensor and responsive to a signal generated by said first feedback signal means, for generating a second output signal in said network to close said backup tong in gripping engagement with a length of pipe near a joint sensed by said sensing means;
means operatively connected to said backup tong for generating a second feedback signal within said network indicative of the closed condition of said backup tong and for generating a third feedback signal within said network indicative of the open position of said backup tong, and
means responsive to said second feedback signal for generating a third output signal within said network to actuate the driven tong to effect the make-up or break-out of a joint sensed by said sensing means.

9. The tongs arrangement of claim 8 wherein said control system further includes:
means for extending said joint sensing means, in response to actuation of said fourth output signal generating means, only when said driven and backup tongs are within predetermined limits between said first and second positions.

10. In a tongs arrangement for making and breaking a joint between a first and a second length of drill pipe, said tongs arrangement including a backup tong, a driven tong, means for lifting and lowering the backup and driven tongs, and a tongs motor for rotating the driven tong to effect the make-up and break-out of a pipe joint between lengths of drill pipe, wherein the improvement comprises a tongs control system having:
an enabling network responsive to a first command signal for selectively enabling the generation of signals to effect the make-up or break-out of a joint between lengths of drill pipe;
first output signal generating means operatively connected to the tongs lifting and lowering means and responsive to a second command signal for generating a first output signal to lift the tongs from a first, storage, position to a second, predetermined operating, position and for stopping upward motion of the tongs in response to a first feedback signal;
a joint sensor extendable to a position in contact with one of the lengths of drill pipe in response to a third command signal and retractable in response to the first feedback signal for disposing the backup and the driven tong in the predetermined operating position with respect to a joint between the lengths of drill pipe;
first feedback signal generating means operatively connected to the joint sensor for generating a first feedback signal representative of the disposition of the backup and driven tongs in the predetermined operating location with respect to a joint between the lengths of drill pipe;
second output signal generating means operatively connected to the joint sensor and responsive to the first feedback signal for generating a second output signal to close the backup tong into gripping engagement with one of the lengths of drill pipe;
second feedback signal generating means operatively connected to the backup tong for generating a second feedback signal representative of the closed condition of the backup tong;
third feedback signal generating means operatively connected to the backup tong for generating a third feedback signal representative of the open condition of the backup tong; and,
third and fourth output signal generating means responsive to the first command signal, to a fourth command signal and to the second feedback signal for generating a third output signal or a fourth output signal to the tongs motor to rotate the driven tong in a direction to effect the make-up or break-out of a joint between the lengths of drill pipe.

11. The tongs control system of claim 10 wherein the tongs lifting and lowering means displace the tongs past a standby reference position intermediate the lower and operating positions and further comprising:
fourth feedback signal generating means for generating a fourth feedback signal representative of the location of the tongs at least at the standby reference position.

12. The tongs control system of claim 11 wherein the tongs lifting and lowering means includes an arrangement for controlling lift speed, the tongs being movable from the storage to the standby position at a first predetermined speed, and further comprising:

fifth output signal generating means responsive to the first output signal generating means and to the fourth feedback signal to generate a fifth output signal to shift the speed at which the tongs are moved from the standby to the operating position from the first predetermined speed to a second, slower, speed.

13. The tongs control arrangement of claim 12 wherein the first output signal generating means is responsive to the first feedback signal to halt the motion of the tongs.

14. The tongs arrangement of claim 12 further comprising:

third command signal generating means responsive to the fourth output signal generating means and the fourth feedback signal for generating the third command signal to extend the joint sensor only when the tongs are being lifted and the tongs have passed the standby reference position.

15. The tongs control arrangement of claim 14 wherein the third command signal generating means is responsive to the first feedback signal to retract the joint sensor.

16. The tongs control arrangement of claim 10 including a stabber for guiding an upper length of drill pipe into a lower length of drill pipe and further comprising:

fifth command signal generating means responsive to the first feedback signal to generate a fifth command signal to extend the stabber and responsive to the fourth command signal to retract the stabber.

17. The tongs control arrangement of claim 16 further comprising fifth feedback signal generating means operatively connected to the stabber for generating a fifth feedback signal representative of the extension of the stabber.

18. The tongs control arrangement of claim 10 wherein the joint sensor is responsive to the first feedback signal to retract the joint sensor and further comprising:

sixth feedback signal generating means operatively connected to the joint sensor for generating a sixth feedback signal representative of the retraction of the joint sensor and wherein the second output signal generating means generates the second output signal in response to the sixth feedback signal.

19. The tongs control arrangement of claim 10 further comprising:

seventh feedback signal generating means operatively connected to the tongs motor for generating a seventh feedback signal representative of a fully engaged joinder of the first and second lengths of drill pipe to stop rotation of the tongs motor; and, a timer operatively connected to the tongs motor and responsive to the seventh feedback signal for generating the fourth output signal to reverse the tongs motor to open the driven tong and also responsive to the seventh feedback signal for opening the backup tong.

20. The tongs control arrangement of claim 10 further comprising sixth output signal generating means operatively connected to the tongs lifting and lowering means and responsive to the third feedback signal for generating a sixth output signal to lower the tongs to the first, storage, position.

21. The tongs control arrangement of claim 10 further comprising:

backup closed memory means responsive to the first output signal and the second feedback signal for generating a first enabling signal;

joint sensed memory means responsive to the first output signal and to the first feedback signal for generating a second enabling signal; and, a logic arrangement operatively connected to the second output signal generating means and responsive to the third feedback signal and the first and second enabling signals for permitting opening of the backup tong only when the backup tong has been closed and the joint has been sensed.

22. The tongs control arrangement of claim 10 wherein the first, second, and fourth command signals are output to the tongs control system from a general purpose programmable digital computer operating under the control of a program.

* * * * *

UNITED STATES PATENT OFFICE

CERTIFICATE OF CORRECTION

Patent No. 4,202,225 Dated May 13, 1980

Inventor(s) Loren B. Sheldon, James R. Tomashek, Donald H. Ward.

It is certified that error appears in the above-identified patent and that said Letters Patent are hereby corrected as shown below:

On the cover page, below the heading "Inventors", insert the following:

Assignee: BJ-HUGHES Inc.
Houston, TX

Signed and Sealed this

*Seventeenth* Day of *February 1981*

[SEAL]

*Attest:*

RENE D. TEGTMEYER

*Attesting Officer*

*Acting Commissioner of Patents and Trademar*